US009157715B1

(12) United States Patent
Lafortune et al.

(10) Patent No.: US 9,157,715 B1
(45) Date of Patent: Oct. 13, 2015

(54) POLYMER MARKING PROJECTILE WITH INTEGRATED METALLIC SEALING RING

(71) Applicant: General Dynamics Ordnance and Tactical Systems—Canada Inc., Repentigny (CA)

(72) Inventors: Eric Lafortune, Terrebonne (CA); Luis de Sousa, Bois-des-Fillion (CA)

(73) Assignee: General Dynamics Ordnance and Tactical Systems—Canada Inc., Quebec (CA)

( * ) Notice: Subject to any disclaimer, the term of this patent is extended or adjusted under 35 U.S.C. 154(b) by 0 days.

(21) Appl. No.: 14/277,300

(22) Filed: May 14, 2014

(51) Int. Cl.

| | |
|---|---|
| ***F42B 12/40*** | (2006.01) |
| ***F42B 12/76*** | (2006.01) |
| ***F42B 8/12*** | (2006.01) |
| ***F42B 14/02*** | (2006.01) |
| ***F42B 33/00*** | (2006.01) |

(52) U.S. Cl.
CPC . *F42B 12/40* (2013.01); *F42B 8/12* (2013.01); *F42B 12/76* (2013.01); *F42B 14/02* (2013.01); *F42B 33/00* (2013.01)

(58) Field of Classification Search
CPC ..... F42B 12/34; F42B 12/36; F42B 12/40; F42B 12/46; F42B 12/50; F42B 12/52; F42B 12/56; F42B 14/02; F42B 8/12; F42B 8/14; F42B 8/16
USPC ..... 102/502, 508, 512, 513, 517, 524, 529
See application file for complete search history.

(56) References Cited

U.S. PATENT DOCUMENTS

| | | | | |
|---|---|---|---|---|
| 3,645,208 | A | 2/1972 | Weinssen et al. | |
| 3,732,821 | A | 5/1973 | Royer | |
| 3,983,817 | A * | 10/1976 | Tucker | 102/513 |
| H000114 | H * | 8/1986 | Quintavalle | 102/513 |
| 4,603,637 | A * | 8/1986 | Snide et al. | 102/529 |
| 4,873,416 | A * | 10/1989 | Boeder | 219/121.64 |
| 5,035,183 | A | 7/1991 | Luxton | |
| 5,081,931 | A * | 1/1992 | Frye et al. | 102/489 |
| 5,359,937 | A | 11/1994 | Dittrich | |
| 6,401,622 | B1 * | 6/2002 | Brinkmann | 102/524 |
| 6,412,419 | B1 * | 7/2002 | Brinkmann | 102/524 |
| 7,331,293 | B2 | 2/2008 | Saxby | |
| 8,286,557 | B2 | 10/2012 | Endicott et al. | |

(Continued)

FOREIGN PATENT DOCUMENTS

WO 2013082557 A1 6/2013

OTHER PUBLICATIONS

Canadian International Searching Authority, International Search Report and Written Opinion for International Application No. PCT/CA2015/050302, mailed Jul. 8, 2015.

*Primary Examiner* — Bret Hayes
(74) *Attorney, Agent, or Firm* — Ingrassia, Fisher & Lorenz, PC

(57) ABSTRACT

A marking projectile configured to be fired through the barrel of a firearm having rifling formed therein is provided. The marking projectile includes a polymeric base portion configured to engage the rifling of the barrel and a polymeric front shell portion coupled to the base portion. The polymeric front shell portion has a cavity formed therein for housing a marking compound and a structure configured to deform on impact and thereby release the marking compound. The marking projectile includes a metallic annular sealing component (e.g., a crimped metal ring) configured to seal the polymeric front shell portion to the polymeric base portion.

19 Claims, 5 Drawing Sheets

(56) References Cited

U.S. PATENT DOCUMENTS

| | | | | |
|---|---|---|---|---|
| 8,327,767 | B2 | 12/2012 | Lafortune | |
| 8,485,102 | B2 | 7/2013 | Carlson et al. | |
| 2005/0284325 | A1 | 12/2005 | Saxby | |
| 2006/0032393 | A1 | 2/2006 | Haeselich | |
| 2007/0289475 | A1* | 12/2007 | Kapeles | 102/502 |
| 2008/0053330 | A1 | 3/2008 | Haeselich | |
| 2011/0048270 | A1* | 3/2011 | Gustavsson | 102/473 |
| 2011/0079164 | A1* | 4/2011 | Broden et al. | 102/444 |
| 2011/0155016 | A1* | 6/2011 | Marx | 102/524 |
| 2011/0259232 | A1* | 10/2011 | Marx | 102/527 |
| 2012/0067242 | A1 | 3/2012 | Shin et al. | |
| 2012/0192751 | A1 | 8/2012 | Lafortune | |
| 2014/0026778 | A1 | 1/2014 | Saxby | |
| 2014/0318402 | A1* | 10/2014 | Carlson et al. | 102/439 |

* cited by examiner

POLYMER MARKING PROJECTILE WITH INTEGRATED METALLIC SEALING RING

TECHNICAL FIELD

The technical field generally relates to training projectiles used in connection with rifled weapons, and more particularly relates to non-lethal, polymer marking projectiles.

BACKGROUND

Non-lethal, low-energy marking projectiles are often used in connection with small-caliber rifled weapons (e.g., pistols, rifles, submachine guns, and the like) to provide a realistic training experience. Such projectiles typically include a polymeric frontmost shell portion enclosing a semi-viscous color marking compound and a rear base portion that engages the shell portion. Engagement between the shell and base is typically provided via an interference fit or snap-fit. The shell portion is configured such that, during impact, the marking compound is expelled from the shell in a controlled manner, typically along pre-defined break lines.

Known polymer marking projectiles may be unsatisfactory in a number of respects. For example, sub-optimal storage of such projectiles—particularly projectiles utilizing water-based marking compounds—can result in significant moisture evaporation through the shell/base interface and consequently a reduction in viscosity and mass of the marking compound. This aging effect, which is exacerbated by high temperature and humidity conditions, is due in part to the difficulty in achieving an airtight seal between polymeric components, which are notoriously subject to high dimensional tolerances and various assembly constraints.

Premature aging in the form of moisture loss and marking compound phase change may result in a diminished marking effect and/or a non-uniform mass distribution, which itself can lead to a reduction in gyroscopic stability at the weapon muzzle. Furthermore, within any particular batch of marking projectiles, the moisture-loss may vary widely between individual projectiles. This results in an increased variation in projectile muzzle velocity and increased impact dispersion.

Accordingly, it is desirable to provide improved polymer marking projectiles with improved shelf life and flight stability. Other desirable features and characteristics of the present invention will become apparent from the subsequent detailed description and the appended claims, taken in conjunction with the accompanying drawings and the foregoing technical field and background.

SUMMARY

A marking projectile in accordance with one embodiment is configured to be fired through the barrel of a firearm having rifling formed therein. The marking projectile includes a polymeric base portion configured to engage the rifling of the barrel and a polymeric front shell portion coupled to the base portion. The polymeric front shell portion has a cavity formed therein for housing a marking compound and a structure configured to deform on impact and thereby release the marking compound. The marking projectile also includes a metallic annular sealing component configured to seal the polymeric front shell portion to the polymeric base portion.

In accordance with one embodiment, a method is provided for forming a marking projectile configured to be fired through the barrel of a firearm having rifling formed therein. The method includes: forming a polymeric base portion configured to engage the rifling of the barrel; forming a polymeric front shell portion having a cavity formed therein and having a structure configured to deform on impact to expose the cavity; inserting a marking compound in the cavity; coupling the polymeric base portion to the polymeric front shell portion; and sealing the polymeric front shell portion to the polymeric base portion with a metallic annular sealing component.

In accordance with one embodiment, a marking projectile is configured to be fired through the barrel of a firearm having rifling formed therein. The marking projectile includes polymeric base portion configured to engage the rifling of the barrel, and a polymeric front shell portion coupled to the base portion such that the base portion and the front shell portion partially overlap axially. The polymeric front shell portion has a cavity formed therein for housing a marking compound and a structure configured to deform on impact and thereby release the marking compound. The marking projectile also includes a crimped metal ring configured to seal the polymeric front shell portion to the polymeric base portion by applying a radial compressive force thereto. The crimped metal ring has an uncrimped portion co-molded to the polymeric base portion, and a crimped portion applying radial compression to the outer surface of the polymeric front shell portion.

DESCRIPTION OF THE DRAWINGS

The exemplary embodiments will hereinafter be described in conjunction with the following drawing figures, wherein like numerals denote like elements, and wherein.

DETAILED DESCRIPTION

Figure 1:
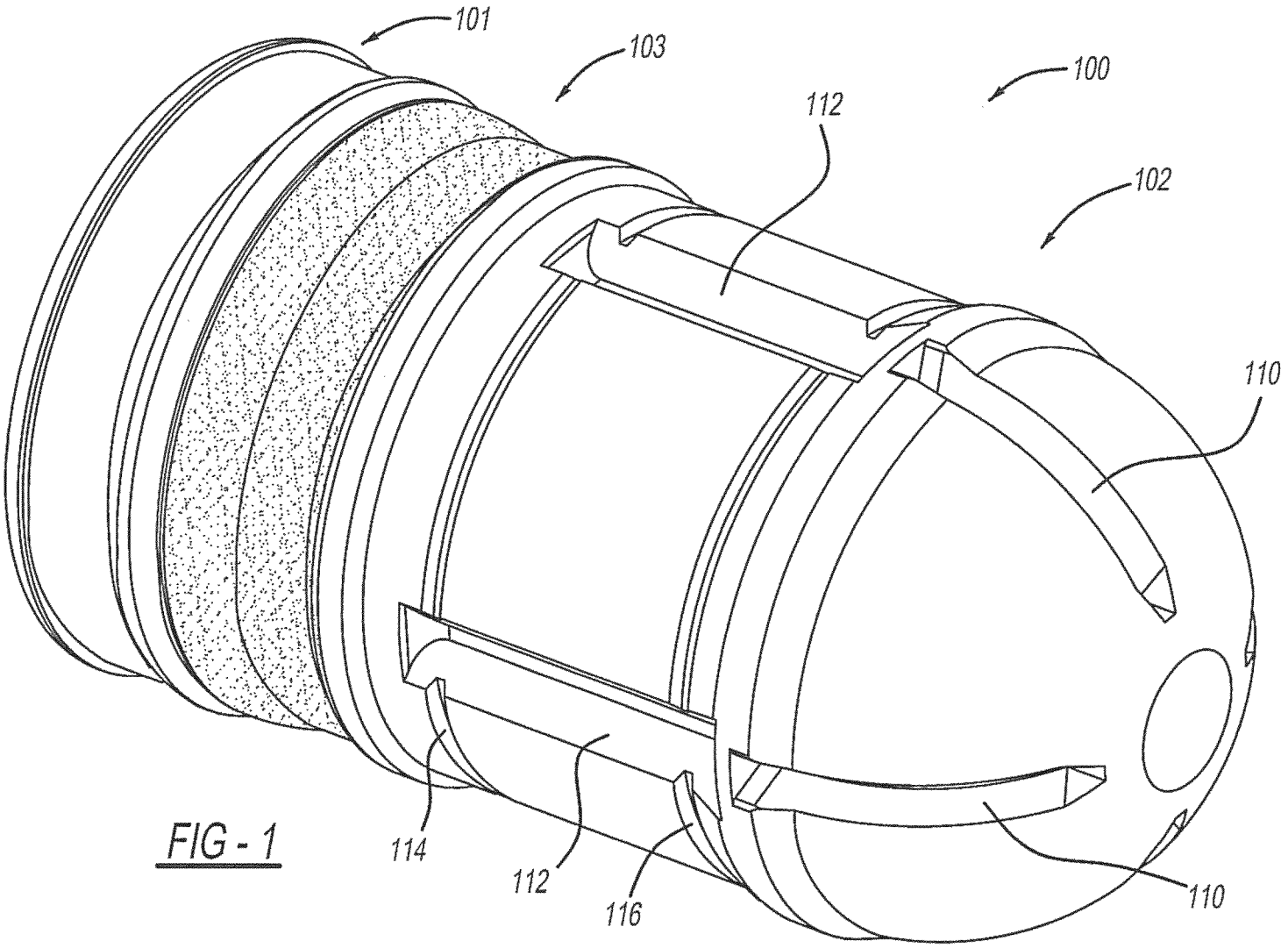
FIG. 1 is an isometric overview of a marking projectile in accordance with one embodiment.

In general, the subject matter described herein relates to an improved, non-lethal, polymeric marking projectile that incorporates a metallic annular seal (e.g., via a crimped ring) that significantly improves shelf-life while at the same time increasing projectile stability. In that regard, the following detailed description is merely exemplary in nature and is not intended to limit the application and uses. Furthermore, there is no intention to be bound by any expressed or implied theory presented in the preceding technical field, background, brief summary or the following detailed description. It will be understood that the drawing figures are not necessarily drawn to scale and may be referred to herein, without loss of generality, as "isometric" (as opposed to "perspective") drawings even when such drawings are not strictly isometric, but are otherwise axonometric as is known in the art. The nature and operation of conventional ammunition and firearms, particularly rifled firearms, are well known and need not be described in detail herein.

Referring now to the isometric exterior view of FIG. 1, a marking projectile 100 in accordance with one embodiment generally includes a polymeric base portion (or simply "base portion") 101, a polymeric front shell portion (or simply "shell portion") 102, and a metallic annular sealing component (or simply "sealing component") 103 configured to seal shell portion 102 to base portion 101 (e.g., via crimping of a suitably malleable metallic ring). Base portion 101 is configured to engage the rifling of a barrel (not illustrated), and shell portion 102 has a structure (e.g., including longitudinal grooves 110, 112 and circumferential grooves 114, 116) configured to deform on impact and thereby release marking compound contained therein, as described in further detail below.

As a threshold matter, the term "marking projectile" as used herein refers to the class of non-lethal practice ammunition characterized by its relatively low mass (and thus low energy), and its ability to provide some visual indication of its point of impact, typically through the release of some form of marking compound through a frangible frontmost portion. The various embodiments described herein relate to a "polymer" or "polymeric" marking projectile—i.e., a projectile that is at least partially fabricated using a polymeric plastic material.

Figure 2:
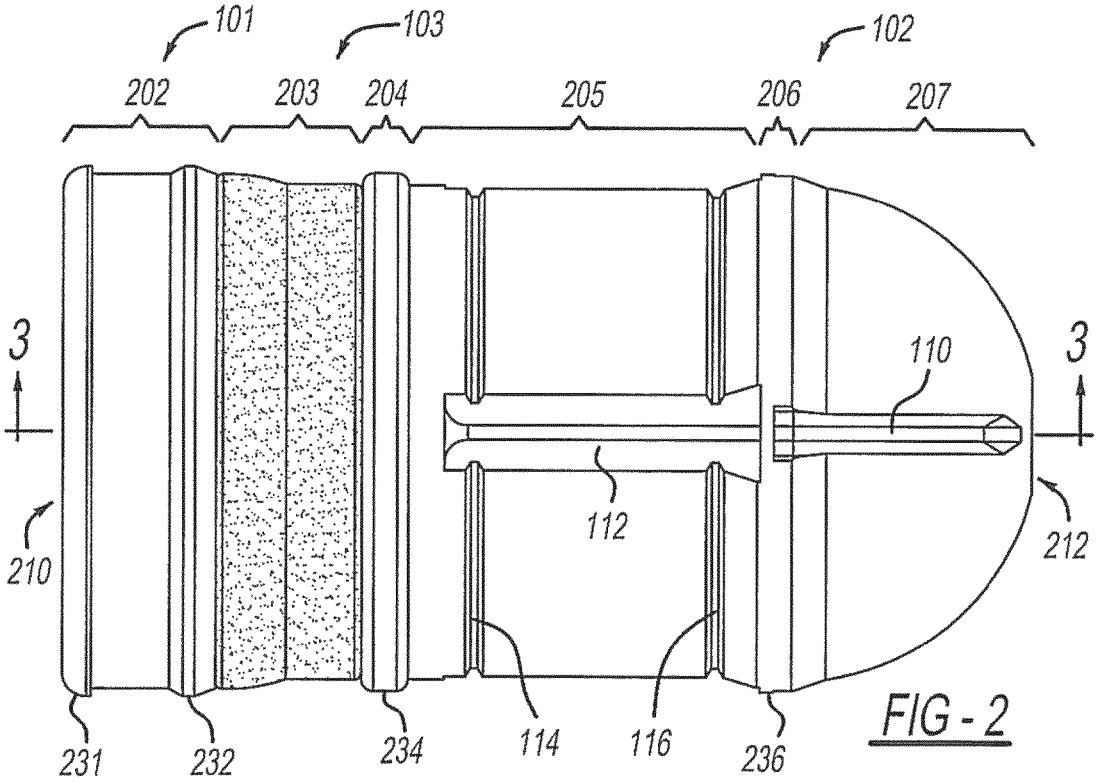
FIG. 2 is a side view of the marking projectile of FIG. 1.
Figure 3:
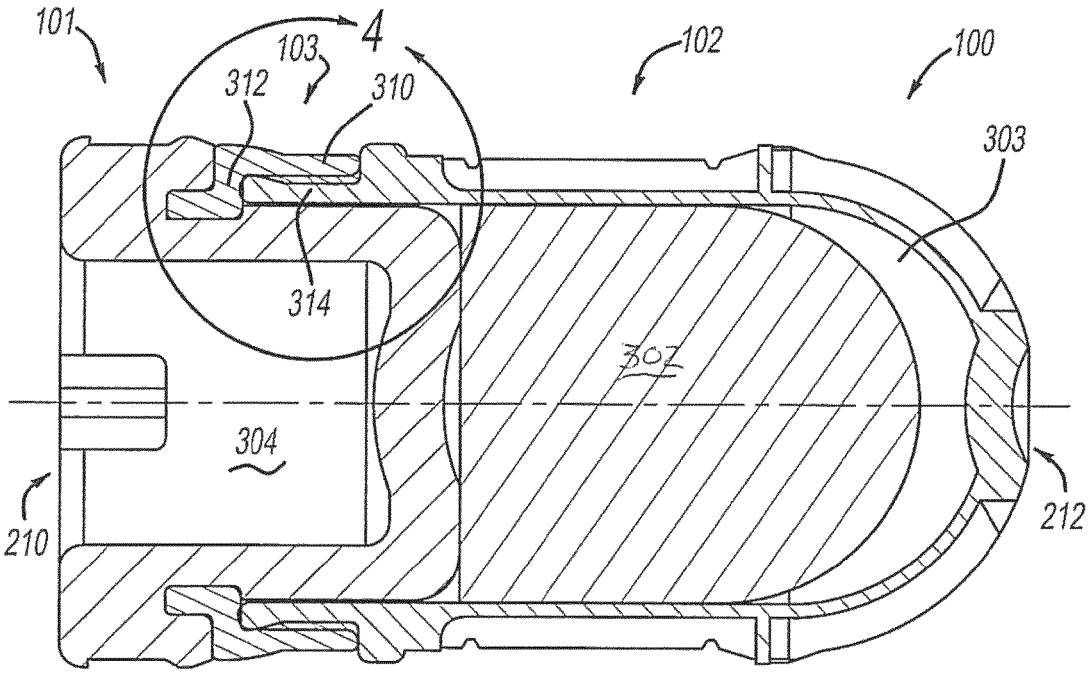
FIG. 3 is a cross-sectional view corresponding to the marking projectile side view depicted in FIG. 2.

Referring now to FIGS. 2 and 3, FIG. 2 is a side view of marking projectile 100 in accordance with the illustrated embodiment, and FIG. 3 is a corresponding cross-sectional view of marking projectile 100 that is generally aligned therewith. As mentioned above in connection with FIG. 1, marking projectile 100 includes three coaxially aligned portions extending from one end 210 (referred to as the "rear") to an opposite end 212 (referred to as the "front" or "impact" end). In one example, marking projectile 100 includes base portion 101, shell portion 102, and metallic annular sealing component 103. As illustrated, sealing component 103 is generally configured to secure shell portion 102 to base portion 101 and at the same time provide a seal between the two components. Various "regions" of marking projectile 100 are demarcated in FIG. 2, namely, regions 202-207 extending from end 210 to end 212. These regions will be referred to in the description below.

As shown in FIG. 3, a cavity 303 in shell portion 102 houses a suitable marking compound 302—e.g., a water, wax, or oil-based marking compound. In some embodiments, marking compound 302 is semi-viscous, and fills a large portion of cavity 303 in such a way that its mass is evenly distributed about the projectile's central axis (indicated by dotted line). In this regard, it will be appreciated that FIG. 3 presents merely one exemplary configuration (e.g., size and shape) for marking compound 302, and is not intended to be limiting.

Marking projectile 100 further includes a rearward cavity 304 configured to, inter alia, receive an expulsion force produced via ignition of a propellant. That is, marking projectile 100 is configured to be incorporated into a cartridge of the type commonly used in connection with firearms, as is known in the art. In the interest in clarity, such cartridge components are not illustrated in the drawings.

Figure 4:
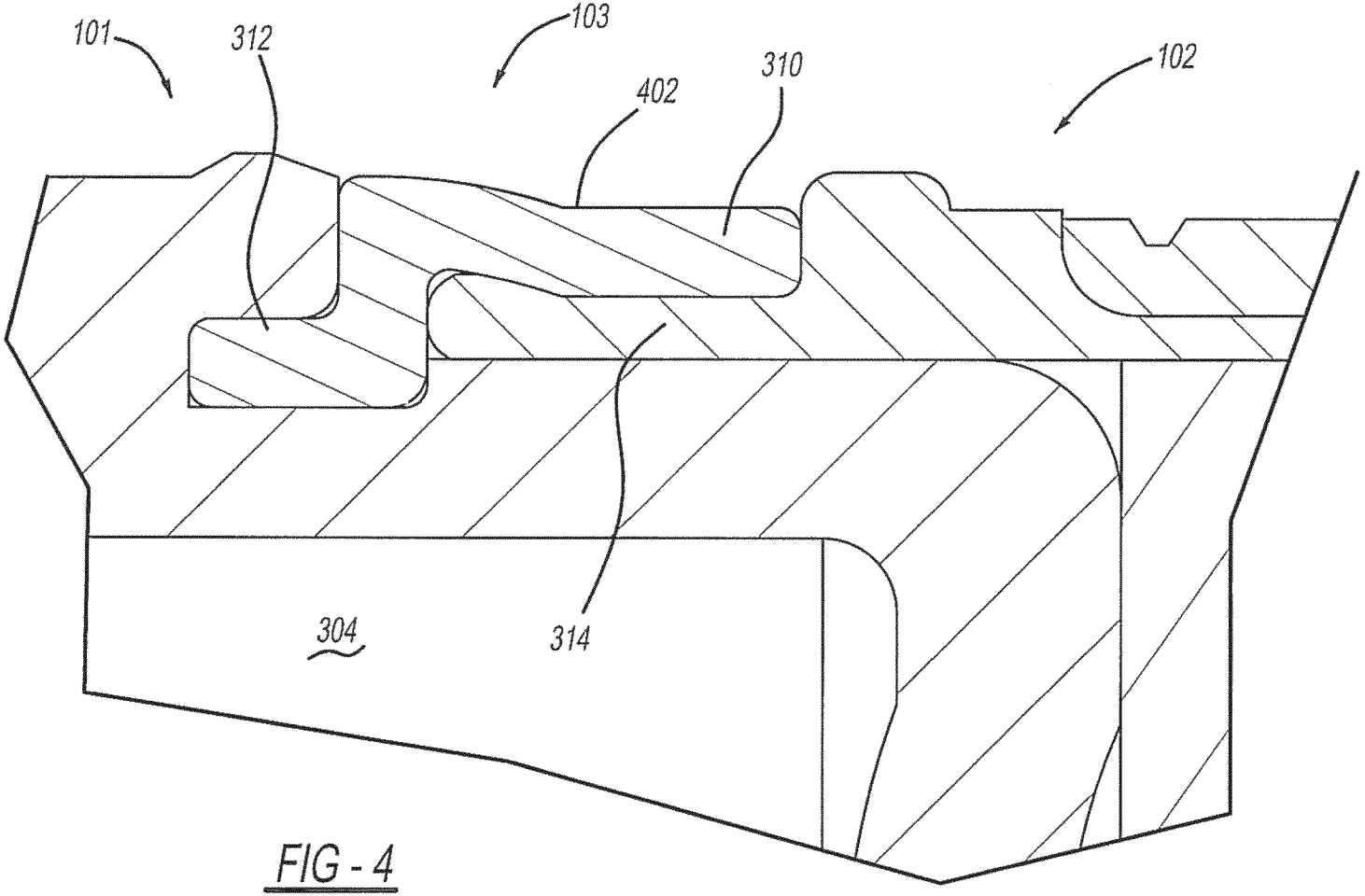
FIG. 4 is cross-sectional detail view of a crimped region '4' of FIG. 3.

Annular seal 103 may be implemented using a variety of structures and materials configured to secure shell portion 102 to base portion 101. For example, a ring like structure (region 203 in FIG. 2) may be provided to apply a radial compressive force (via, for example, plastic deformation) and thereby secure shell portion 102 to base portion 101. In one example, annular seal 103 of the illustrated embodiment comprises a crimped metallic ring. That is, as shown in FIG. 3, and as further shown in the detail view of FIG. 4, base portion 101 is partially overlapped, co-axially, by front shell portion 102, and the crimped metal ring (103) has an uncrimped portion 312 at least partially embedded (or otherwise coupled or secured) within base portion 101, and a crimped portion 310 applying radial compression (i.e., inward with respect to the central axis) to an outer surface of the front shell portion 102.

The axial length of sealing component 103 may be selected to achieve the desired level of projectile stability in light of other trade-offs. In one embodiment, for example, sealing component 103 has an axial length (as seen in FIG. 3) that is greater than about 5.0% of the total length of the marking projectile (i.e., extending from end 210 to end 212). In one embodiment, sealing component 103 has an axial length that is between approximately 17% and 25% of the total length of marking projectile 100.

Sealing component 103 may be fabricated from a variety of materials, but is generally a sufficiently malleable metallic that provides the desired level of radial crimping force, which may vary depending upon the size and shape of the marking projectile. As used herein, the term "malleable" refers to the extent to which a material deforms plastically in response to compressive stress without fracture. In one embodiment, sealing component 103 comprises a copper alloy having at least about a 50% copper content, for example, at least about a 65% copper content, and as a further example, at least about an 85% copper content. In addition, other metallic alloys may be used, including without limitation, steel, iron, tin, aluminum, gold, silver, platinum, tungsten, titanium, zinc, sintered metal, and the like.

One advantage of including sealing component 103, in addition to its ability to seal together base portion 101 and shell portion 102, is that its relatively high-mass annular shape increases the gyroscopic stability of marking projectile 100. In one embodiment, for example, the gyroscopic stability of marking projectile 100 at the weapon muzzle is greater than about 1.3 times (preferably about 2.0 times in a 5.56 caliber projectile embodiment) that of a reference marking projectile—i.e., a projectile that only includes base portion 101, shell portion 102, and marking compound 302.

As crimped, sealing component 103 generally has an outer diameter (region 203) that is lower than the outer diameter of both shell portion 102 and base portion 101. This prevents potentially scratching targets, such as protective mask lenses, car paint, and the like. It also prevents sealing component 103 from engaging the rifling of the barrel.

In the illustrated embodiment, base portion 101 includes a stepped circumferential driving band region (region 202 in FIG. 2) configured to engage the rifling of the barrel and collect and remove residue from the barrel. This is illustrated in FIG. 2 as a two axial "steps" within region 202, starting from a high outer diameter 231, to a lower diameter region, and then to another high outer diameter 232. The region in the vicinity of outer diameter 232 engages the rifling of the barrel, and the region in the vicinity of outer diameter 231 (which is preferably configured as a sharp leading edge, as shown) collects and removes residue from the barrel, including residue produced through the engagement of outer diameter 232 with the rifling. Outer diameter 231 will also, to some extent, engage the rifling of the barrel. As illustrated, driving band region 202 will generally be the only portion of marking projectile 100 that engages the rifling of the barrel, as it includes the regions of marking projectile 100 with the highest outer diameter (FIG. 2).

Front shell portion 102 includes at least one circumferential guiding band region (regions 204 and 206 in FIG. 2), separated by a body region 205 provided therebetween. Guiding band regions 204 and 206 are configured to provide aligned engagement of the polymeric base portion with the rifling of the barrel. That is, while regions 204 and 206 do not "engage" the rifling of the barrel (due to their lower outer diameter compared to region 202), they might contact the inner surface of the barrel from time to time as it translates and spins through the barrel, thereby keeping marking projectile 100 aligned within the barrel. While only two guiding band regions 204 and 206 are illustrated, any number of such guiding band regions may be employed.

As mentioned previously, shell portion 102 includes one or more structural details configured to allow marking projectile 100 to deform on impact and thereby release the marking compound held within. In some embodiments, shell portion 102 includes a number of longitudinal grooves 112 and 110 (regions 205 and 207 of FIG. 2), as well as one or more circumferential grooves 114 and 116 (region 205 in FIG. 2). The depth of circumferential grooves 112 and 110 will vary depending upon design factors, but in one embodiment one or more of the grooves are at least about 25% the thickness of shell portion 102. It has been found that circumferential grooves 114 and 116 effectively act as "fold zones" and thereby assist longitudinal grooves 112 and 110 in opening during impact.

A variety of polymeric materials and manufacturing techniques may be used for forming the base portion 101 and shell portion 102. As base portion 101 will generally not deform significantly during impact, it may be fabricated with a polymeric material that is different from (and heavier than) that used for fabrication of shell portion 102. Suitable polymeric materials include, without limitation, Acrylonitrile Butadiene Styrene (ABS), acetal, Nylon, polycarbonate, polyethylene, polypropylene, Polyvinylchloride (PVC), and Teflon. The selected polymer preferably exhibits a low permeability to aide in minimizing moisture transfer through the thin-walled projectile shell body.

Figure 9:
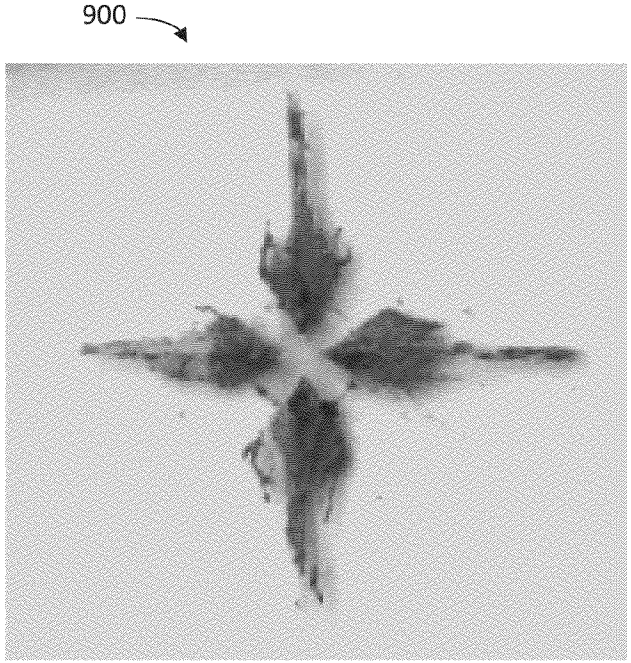
FIG. 9 illustrates a marking pattern resulting from impact in accordance with one embodiment.

The various structural details of shell portion 102 generally allow shell portion 102 to "mushroom" (e.g., deform to form a generally mushroom shape) and thereby absorb impact energy and releases the marking compound in a particularly desirable pattern. In this regard, FIGS. 6-8 depict progressive deformation of an exemplary marking projectile during impact, and FIG. 9 illustrates a marking pattern resulting from impact in accordance with one embodiment.

Figure 6:
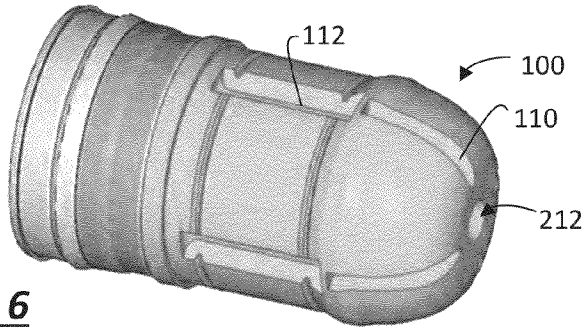
FIGS. 6-8 depict progressive deformation of an exemplary marking projectile during impact.
Figure 7:
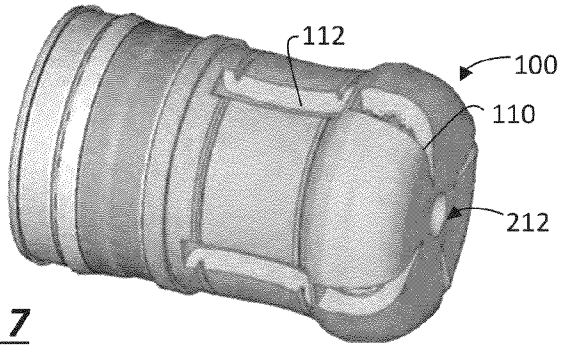
Figure 8:
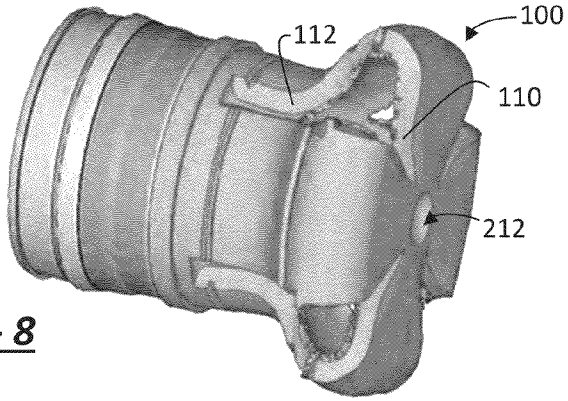

More particularly, FIGS. 6-8 depict deformation in accordance with one computer-based model, and is merely presented as an example (but not necessarily a strictly realistic example) of how shell portion 102 might deform upon impact. As can be seen, as impact progresses (due to contact of front surface 212 with a target, not illustrated), grooves 110 and 112 gradually fracture to expose the marking compound held within. The timing and extent of this deformation may be modulated by the size and position of the circumferential grooves 114 and 116, as previously described. FIG. 9 shows the resulting marking pattern 900, characterized by radial segments (in this case, four radial segments) extending from the central contact point. It will be appreciated that the invention is not so limited, however, and that marking pattern 900 will vary depending upon the number and size of grooves incorporated into shell portion 102.

Figure 5:
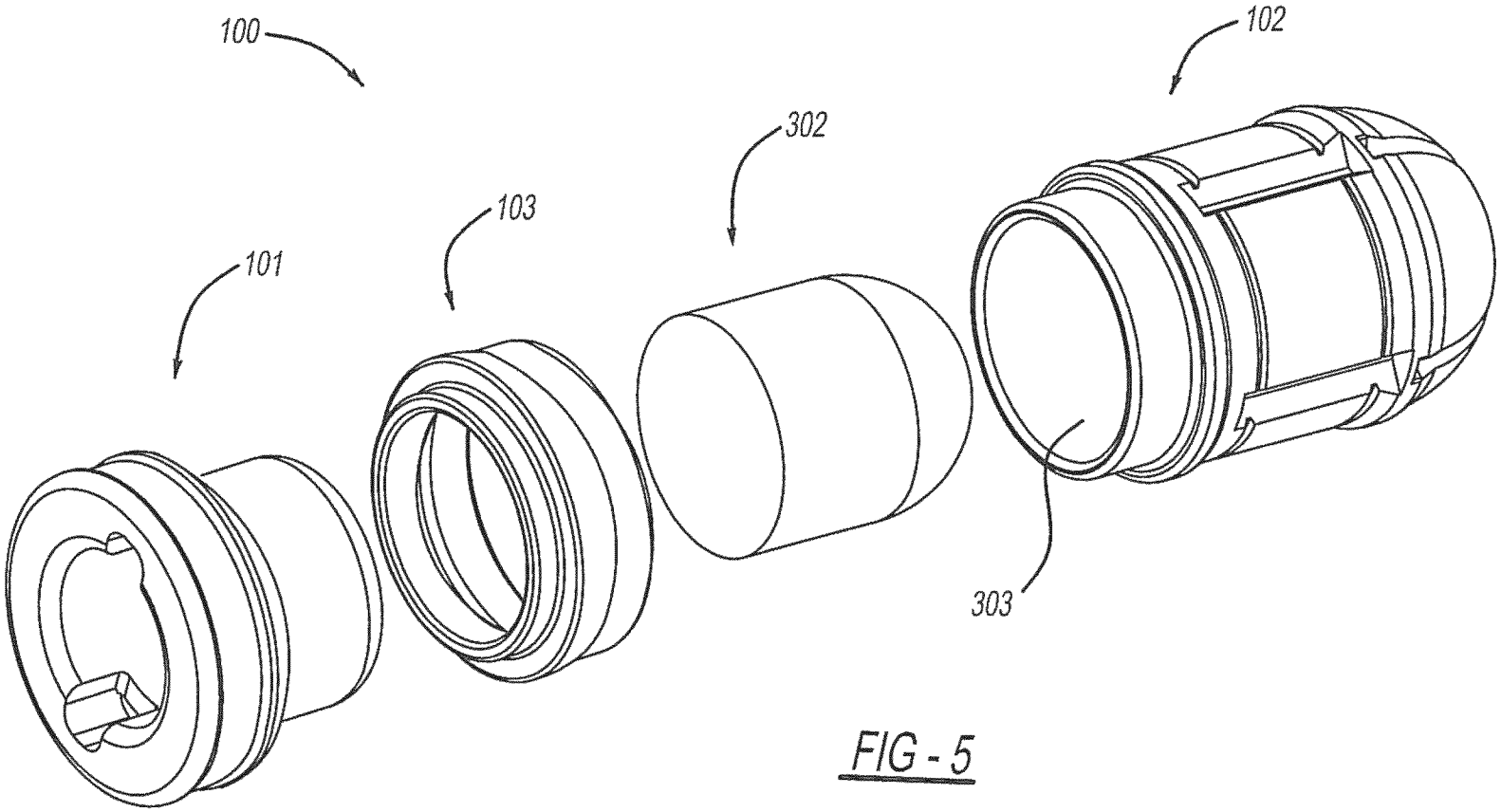
FIG. 5 is an exploded view of a marking projectile in accordance with one embodiment.

A variety of manufacturing and assembly methods may be employed to produce a marking projectile 100 as described above. In that regard, FIG. 5 is an exploded view of the various components of marking projectile 100. In accordance with one embodiment, the method includes the steps of (1) forming base portion 101 such that it is configured to engage the rifling of the barrel; (2) forming shell portion 102 such that it includes a cavity 303 and has one or more structural features configured to deform on impact to expose cavity 303 (as described in further detail above); (3) depositing, dispensing, or otherwise inserting marking compound 302 into cavity 303; (4) coupling base portion 101 to shell portion 102 (e.g., via inserting one component coaxially into the other); and (5) sealing shell portion 102 to base portion 101 with metallic annular sealing component 103—e.g., buy providing an circumferential crimp to sealing component 103 using any of a variety of conventional crimping tools known in the art.

In some embodiments, sealing component 103 and base portion 101 are manufactured as separate components. In other embodiments, however, sealing component 103 may be "co-molded" with base portion 101, thereby simplifying assembly.

In one embodiment, base portion 101, shell portion 102, marking compound 302, and sealing component 103 together form a 5.56 mm projectile having a mass between about 0.25 and about 0.50 grams. Other projectile calibers that could benefit from the disclosed subject matter include, without limitation, 0.380 Auto, 0.40 caliber S&W, 7.62 mm NATO, and 9 mm Para. Such projectiles might have mass values of up to 0.75 g.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A marking projectile configured to be fired through the barrel of a firearm having rifling formed therein, the marking projectile comprising:

a polymeric base portion configured to engage the rifling of the barrel;

a polymeric front shell portion coupled to the base portion, the polymeric front shell portion having a cavity formed therein for housing a marking compound and having a structure configured to deform on impact and thereby release the marking compound; and a metallic annular sealing component configured to seal the polymeric front shell portion to the polymeric base portion;

wherein the metallic annular sealing component is configured to seal the polymeric front shell portion to the polymeric base portion by applying radial compression to the outer surface of the polymeric front shell portion.

2. The marking projectile of claim 1, wherein the metallic annular sealing component comprises a crimped metallic ring.

3. The marking projectile of claim 1, wherein the metallic annular sealing component has an axial length that is greater than 5.0% of a total length of the marking projectile.

4. The marking projectile of claim 3, wherein the metallic annular sealing component has an axial length that is between approximately 17% and 25% of a total length of the marking projectile.

5. The marking projectile of claim 1, wherein the metallic annular sealing component comprises a copper alloy having at least a 50% copper content.

6. The marking projectile of claim 1, wherein the polymeric base portion, the polymeric front shell portion, the marking compound, and the metallic annular sealing component together form a 5.56 mm projectile having a mass between 0.25 and 0.50 grams.

7. The marking projectile of claim 1, wherein the metallic annular sealing component is configured such that the gyroscopic stability of the marking projectile at the barrel exit is greater than 1.3 times that of a reference marking projectile comprising only the base portion, the front shell portion, and the marking compound.

8. The marking projectile of claim 1, wherein the polymeric base portion includes a stepped circumferential driving band region configured to engage the rifling of the barrel and collect and remove residue from the barrel.

9. The marking projectile of claim 1, wherein the polymeric front shell portion includes at least one circumferential guiding band region configured to provide aligned engagement of the polymeric base portion with the rifling of the barrel.

10. The marking projectile of claim 1, wherein the structure configured to deform on impact comprises at least one circumferential groove formed in the polymeric front shell portion.

11. A marking projectile configured to be fired through the barrel of a firearm having rifling formed therein, the marking projectile comprising:

a polymeric base portion configured to engage the rifling of the barrel;

a polymeric front shell portion coupled to the base portion, the polymeric front shell portion having a cavity formed therein for housing a marking compound and having a structure configured to deform on impact and thereby release the marking compound; and a metallic annular sealing component configured to seal the polymeric front shell portion to the polymeric base portion;

wherein:

the base portion is partially overlapped, co-axially, by the front shell portion, and the crimped metal ring has an uncrimped portion at least partially embedded within the polymeric base portion and a crimped portion applying radial compression to an outer surface of the polymeric front shell portion.

12. A method of forming a marking projectile configured to be fired through the barrel of a firearm having rifling formed therein, the method comprising:

forming a polymeric base portion configured to engage the rifling of the barrel;

forming a polymeric front shell portion having a cavity formed therein and having a structure configured to deform on impact to expose the cavity;

inserting a marking compound in the cavity;

coupling the polymeric base portion to the polymeric front shell portion; and sealing the polymeric front shell portion to the polymeric base portion with a metallic annular sealing component;

wherein the metallic annular seal comprises a ring, and sealing the polymeric front portion to the polymeric base portion comprises crimping the ring onto the front shell portion.

13. The method of claim 12, wherein the metallic annular sealing component is co-molded with the polymeric base portion.

14. The method of claim 12, wherein the metallic annular sealing component has an axial length that is greater than 5.0% of a total length of the marking projectile.

15. The method of claim 12, wherein the metallic annular sealing component comprises a copper alloy having at least a 50% copper content.

16. The method of claim 12, wherein the polymeric base portion is formed with a stepped circumferential driving band region configured to engage the rifling of the barrel and collect and remove residue from the barrel.

17. The method of claim 12, wherein the polymeric front shell portion is formed with at least one circumferential guiding band region configured to provide aligned engagement of the polymeric base portion with the rifling of the barrel.

18. The method of claim 12, wherein the structure of the polymeric front shell portion comprises at least one circumferential groove formed in the polymeric front shell portion.

19. A marking projectile configured to be fired through the barrel of a firearm having rifling formed therein, the marking projectile comprising:

a polymeric base portion configured to engage the rifling of the barrel;

a polymeric front shell portion coupled to the base portion such that the base portion and the front shell portion partially overlap axially, the polymeric front shell portion having a cavity formed therein for housing a marking compound and having a structure configured to deform on impact and thereby release the marking compound; and a crimped metal ring configured to seal the polymeric front shell portion to the polymeric base portion by applying a radial compressive force thereto, the crimped metal ring having an uncrimped portion co-molded the polymeric base portion, and a crimped portion applying radial compression to the outer surface of the polymeric front shell portion.

* * * * *